US008231189B2

(12) United States Patent
Liang et al.

(10) Patent No.: US 8,231,189 B2
(45) Date of Patent: Jul. 31, 2012

(54) UNDERMOUNT DRAWER SLIDE

(75) Inventors: Hsiu-Chiang Liang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 179 days.

(21) Appl. No.: 12/541,341

(22) Filed: Aug. 14, 2009

(65) Prior Publication Data

US 2011/0037365 A1 Feb. 17, 2011

(51) Int. Cl.
*A47B 95/00* (2006.01)

(52) U.S. Cl. ..... 312/334.2; 312/334.1; 312/334.6; 312/334.8

(58) Field of Classification Search ..... 312/330.1, 312/334.1, 334.6, 334.8, 334.11, 334.13–334.18, 312/334.27, 334.32–334.34, 334.36–334.38; 384/18–20

See application file for complete search history.

(56) References Cited

U.S. PATENT DOCUMENTS 2,209,727 A * 7/1940 Gibson ..... 292/36
2,698,214 A * 12/1954 Skamser ..... 312/334.5
2,739,028 A * 3/1956 Siggia ..... 312/334.46
2,747,943 A * 5/1956 Metcalf ..... 384/19
2,749,201 A * 6/1956 Koury et al. ..... 312/323
3,195,171 A * 7/1965 Klein ..... 16/90
3,243,247 A * 3/1966 Knape ..... 312/333
3,574,437 A * 4/1971 Stein et al. ..... 312/334.19
3,906,587 A * 9/1975 Little ..... 16/289
3,954,315 A * 5/1976 Sanden ..... 312/333
4,067,632 A * 1/1978 Sekerich ..... 312/334.9
4,087,123 A * 5/1978 Redshaw ..... 292/341.19
4,141,525 A * 2/1979 Miller ..... 248/251
4,447,095 A * 5/1984 Fielding ..... 384/19
4,615,095 A * 10/1986 Bessinger et al. ..... 29/407.1
4,799,802 A * 1/1989 Lautenschlager ..... 384/19
4,810,045 A * 3/1989 Lautenschlager ..... 312/334.5
4,881,826 A * 11/1989 Grass ..... 384/19
5,056,879 A * 10/1991 Rock et al. ..... 312/334.27
5,090,787 A * 2/1992 Harley ..... 312/334.7
5,310,255 A * 5/1994 Ranallo ..... 312/334.5
5,484,197 A * 1/1996 Hansen et al. ..... 312/334.12
5,570,941 A * 11/1996 Rock et al. ..... 312/334.6
5,588,729 A * 12/1996 Berger ..... 312/334.4

(Continued)

FOREIGN PATENT DOCUMENTS

WO WO 2008134782 A1 * 11/2008

*Primary Examiner* — Darnell Jayne
*Assistant Examiner* — Kimberley S Wright
(74) *Attorney, Agent, or Firm* — Rosenberg, Klein & Lee

(57) ABSTRACT

An undermount drawer slide includes a first rail and a second rail slidable linearly with respect to the first rail. The first rail has a first wall perpendicular to a reference level, and includes a first and a second installation sections. The first installation section has a first vertical distance with respect to the reference level. The second installation section has a second vertical distance with respect to the reference level. The first vertical distance is different from the second vertical distance to form a height difference. The second rail includes a top wall and a protrusion protruding from the top wall. The protrusion has a height measured from the top wall which is substantially equal to the height difference. The protrusion is adapted to hold against a bottom of a drawer for keeping a front panel of the drawer in a level status with respect to a cabinet.

5 Claims, 5 Drawing Sheets

U.S. PATENT DOCUMENTS 5,641,216 A * 6/1997 Grass ..... 312/334.27
5,664,855 A * 9/1997 Lautenschlager et al. . 312/334.4
6,325,473 B1 * 12/2001 Brustle et al. ..... 312/334.13
6,428,128 B1 * 8/2002 Henriott et al. ..... 312/334.12
6,485,120 B1 * 11/2002 Pomerleau et al. ..... 312/334.27
6,749,277 B2 * 6/2004 Michaels ..... 312/334.5
6,854,817 B1 2/2005 Simon
6,945,618 B2 * 9/2005 Kim et al. ..... 312/334.4
7,014,282 B2 3/2006 Hammerle
7,296,863 B2 * 11/2007 Lam et al. ..... 312/334.6
7,533,946 B2 * 5/2009 Hoffman ..... 312/333
7,537,296 B2 5/2009 Leon et al.
7,625,051 B1 * 12/2009 Kim ..... 312/334.5
7,905,561 B2 * 3/2011 Ritter ..... 312/333
8,052,234 B2 * 11/2011 Liang et al. ..... 312/334.4
2003/0052580 A1 * 3/2003 Dobler et al. ..... 312/334.44
2003/0205955 A1 * 11/2003 Egger ..... 312/334.5
2004/0212284 A1 * 10/2004 Fitz ..... 312/334.13
2004/0227440 A1 * 11/2004 Booker et al. ..... 312/334.1
2005/0231083 A1 * 10/2005 Garcie, Jr. ..... 312/333
2006/0049732 A1 * 3/2006 Prentner et al. ..... 312/334.1
2006/0097609 A1 * 5/2006 Milligan et al. ..... 312/319.1
2007/0188060 A1 * 8/2007 Nussbaumer et al. ..... 312/333
2011/0309732 A1 * 12/2011 Horil et al. ..... 312/404
2012/0049712 A1 * 3/2012 Lobbezoo ..... 312/334.12

* cited by examiner

UNDERMOUNT DRAWER SLIDE

BACKGROUND OF THE INVENTION

1. Field of the Invention

This invention relates to a drawer slide, and more particularly, to an undermount drawer slide.

2. Description of the Prior Art

There are quite a few drawer slides on the market, such as U.S. Pat. No. 6,854,817 to Simon, titled "Undermount drawer slide" which disclosed an undermount drawer slide mounted to the bottom of a drawer. When the drawer is pulled outward with respect to a cabinet, the undermount drawer slide is hidden under the bottom of the drawer, not exposed. This undermount drawer slide has an L-shaped bracket which facilitates the mounting in a level status so that the drawer can be pulled outward in a level status with respect to the cabinet.

Referring to FIG. 2 of the aforesaid patent, the bracket has a plurality of mounting holes. The bracket is mounted between the cabinet and the undermount drawer slide. When the cabinet is standing on an uneven floor, the drawer may slide outward from the cabinet and may be hard to close tightly.

In order to solve the above problem, another invention was derived, U.S. Pat. No. 7,537,296 to Leon, titled "Dampened movement mechanism and slide incorporating the same", which disclosed a buffering technique. However, it is not cost-effective.

SUMMARY OF THE INVENTION

This invention relates to an undermount drawer slide to prevent the drawer from sliding away from the cabinet.

According to one aspect of the present invention, there is provided an undermount drawer slide, comprising:

a first rail including a vertical first wall, a first installation section and a second installation section disposed on the first wall, the first installation section having a first vertical distance measured from the center of the first installation section to a reference level, the second installation section having a second vertical distance measured from the center of the second installation section to the reference level, the first vertical distance being different from the second vertical distance to form a height difference, and a second rail slidable linearly with respect to the first rail, the second rail including a top wall having a first end and a second end opposite to the first end, a protrusion disposed between the first end and the second end of the top wall, the protrusion having a height measured from the top wall which is substantially equal to the height difference of the first installation section and the second installation section.

Preferably, the first installation section is a plurality of mounting holes and the second installation section is a plurality of mounting holes.

Preferably, the first wall further includes a third installation section disposed between the first installation section and the second installation section, the third installation section is a plurality of mounting holes corresponding in position to the mounting holes of the first installation section and the second installation section.

Preferably, the protrusion is disposed adjacent the first end of the top wall of the second rail.

Preferably, the undermount drawer slide further comprises a third rail disposed between the first rail and the second rail in a slidable manner.

Preferably, the undermount drawer slide further comprises an engaging member fixed to the second rail and adjacent to the protrusion.

DETAILED DESCRIPTION OF THE PREFERRED EMBODIMENTS

Figure 1:
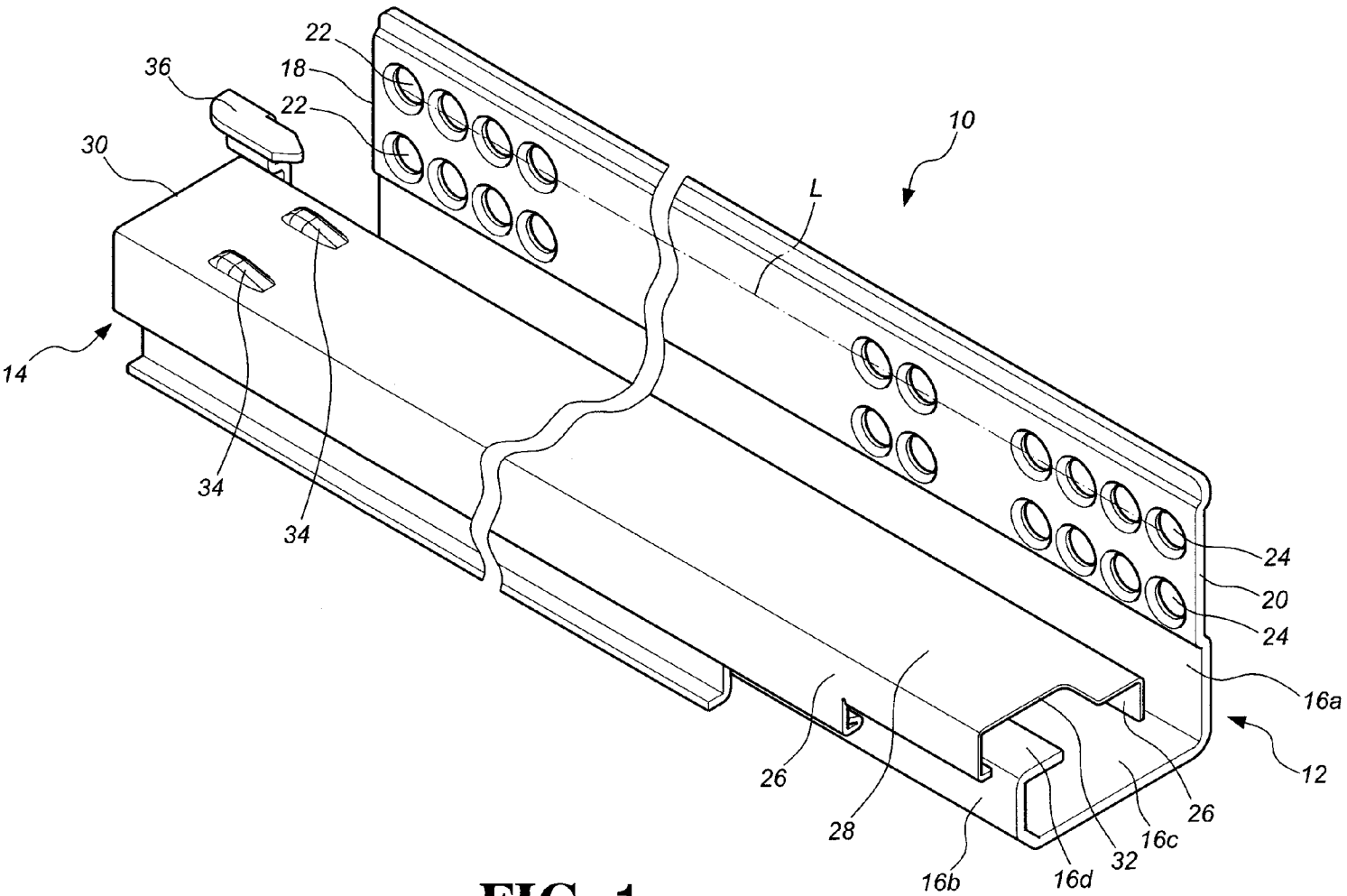
FIG. 1 is a perspective view of an undermount drawer slide according to a first embodiment of the present invention.

As shown in FIG. 1, a drawer slide 10 according to a first preferred embodiment of the present invention comprises a first rail 12 and a second rail 14 which is linearly slidable with respect to the first rail 12.

The first rail 12 comprises a vertical first wall 16*a*, a second wall 16*b*, a third wall 16*c* extending between the first wall 16*a* and the second wall 16*b*, and a fourth wall 16*d* extending transversely from the second wall 16*b*. The first wall 16*a* has a first end 18 and a second end 20 opposite to the first end 18. A first installation section 22 and a second installation section 24 are disposed between the first end 18 and the second end 20 of the first wall 16*a*.

The second rail 14 is linearly slidable with respect to the first rail 12, and comprises a pair of spaced side walls 26 and a top wall 28 extending between the pair of side walls 26. The top wall 28 includes a first end 30, a second end 32 opposite to the first end 30, a protrusion 34 disposed between the first end 30 and the second end 32, and an engaging member 36. Preferably, the protrusion 34 is disposed adjacent the first end 30 of the top wall 28. The engaging member 36 is fixed to the second rail 14 and adjacent to the protrusion 34. In this embodiment, the protrusion 34 is integrally formed with the top wall 28 in a pressing manner.

Figure 2:
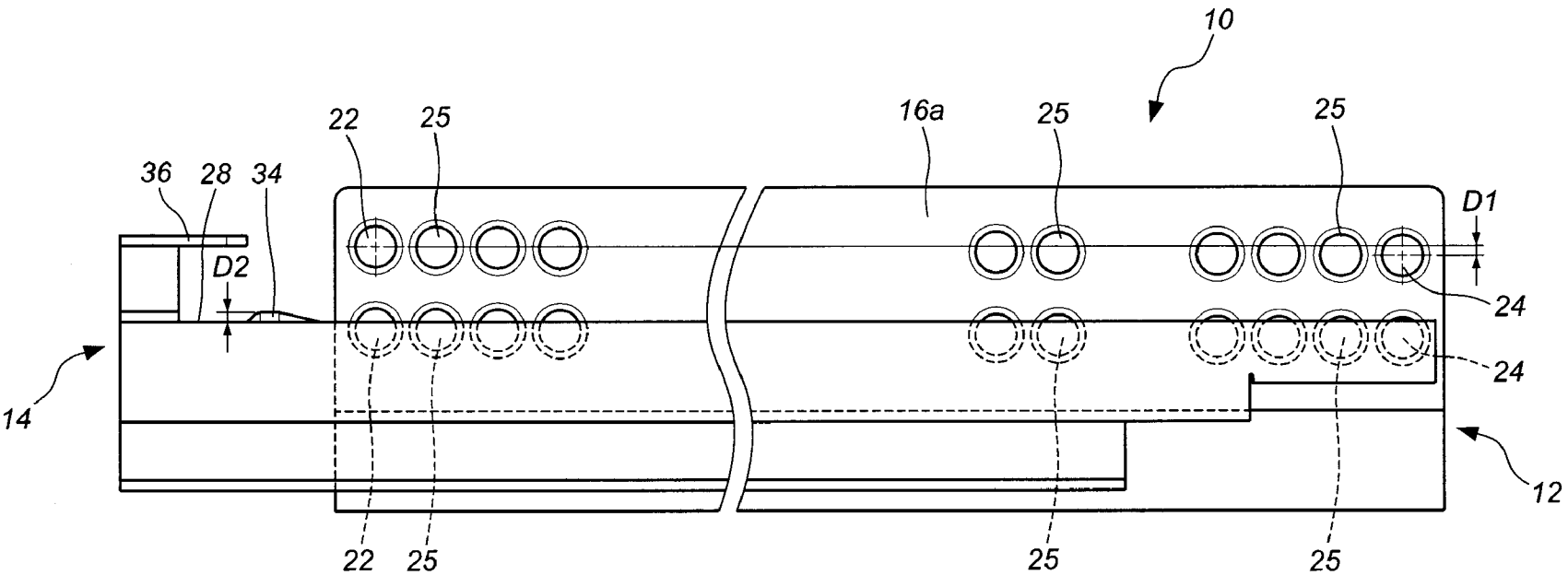
FIG. 2 is a side view of the undermount drawer slide according to the first embodiment of the present invention.

FIG. 2 is a side view of the drawer slide 10 according to the first preferred embodiment of the present invention. The vertical distance from the center of the first installation section 22 of the first rail 12 to a reference level is slightly different from another vertical distance from the center of the second installation section 24 of the first rail 12 to the reference level, which means there is a height difference D1, such as 2 mm, between the center of the first installation section 22 and the center of the second installation section 24. In this embodiment, the first installation section 22 and the second installation section 24 of the first rail 12 have a plurality of mounting holes which are equally arranged in two lines on the first wall 16*a*. The centers of the mounting holes of the first and the second installation sections 22 and 24 at the top line are measured to define the height difference D1. The first wall 16*a* further has a third installation section 25 disposed between the first installation section 22 and the second installation section 24. The third installation section 25 also has a plurality of mounting holes which are equally arranged in two lines corresponding in position to the first installation section 22 and the second installation section 24. The mounting holes of the top line of the third installation section 25 are disposed along a center line L of the first and the second installation sections 22 and 24, as shown in FIG. 1. Preferably, the protrusion 34 of the second rail 14 extends from the top wall 28, and the top wall 28 is parallel to the reference level. The height of the protrusion 34 protruding from the top wall 28 is defined D2 which may be 1.8 mm, 1.9 mm, 2 mm, 2.1 mm or 2.2 mm, corresponding to the height difference D1 of the first rail 12. It is to be noted that the difference of D1 and D2 may be very little or even no difference at all. For those who are familiar to this art would understand the height D2 of the protrusion 34 protruding from the top wall 28 is substantially equal to the height difference D1 of the first rail 12.

Furthermore, the height difference D1 of the first rail 12 may be 1.5 mm, 2.5 mm or others, while the height D2 of the protrusion 34 protruding from the top wall 28 of the second rail 14 substantially corresponds to the height difference D1. To a skilled person of the art, the height D2 of the protrusion 34 protruding from the top wall 28 is substantially equal to the height difference D1 of the first rail 12 within a practicable range.

Figure 3:
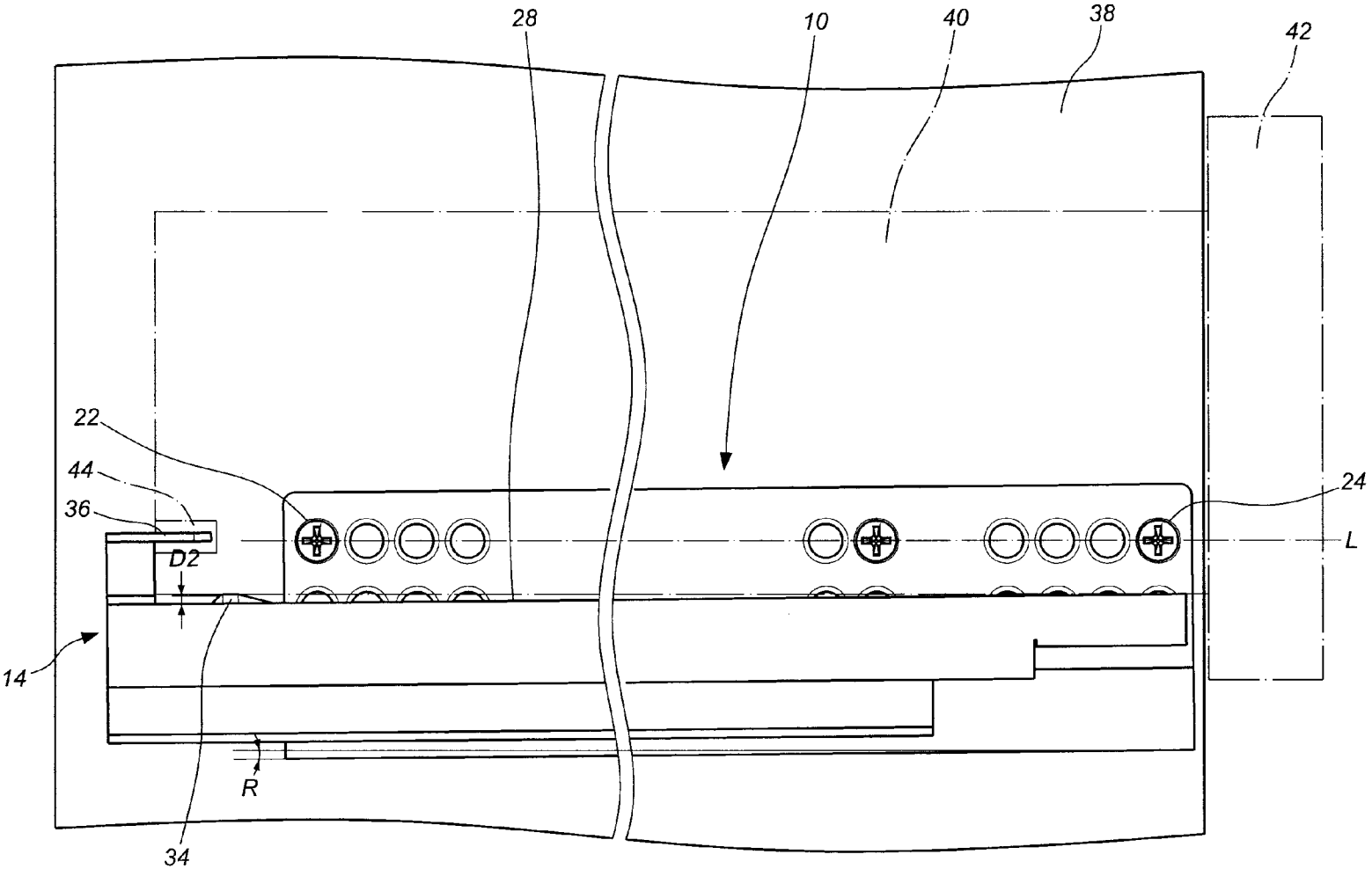
FIG. 3 is a schematic view showing the undermount drawer slide mounted between a cabinet and a drawer according to the first embodiment of the present invention.

FIG. 3 is a schematic view showing the drawer slide 10 mounted between a cabinet 38 and a drawer 40 according to the first embodiment of the present invention. The drawer 40 includes a drawer panel 42. Generally speaking, the drawer 40 is provided with a pair of drawer slides 10 mounted to the bottom of the drawer 40 for providing the drawer 40 a stable and smooth slide in the cabinet 38. To assemble the present invention, the first installation section 22 and the second installation section 24 of the first rail 12 are mounted on front and rear ends of a side wall of the cabinet 38 respectively, with the center line L of the first installation section 22 and the second installation section 24 substantially parallel to the reference level. Because the vertical distances of the first installation section 22 and the second installation section 24 with respect to the reference level are different, upon the drawer slide 10 is mounted to the cabinet 38, the drawer slide 10 will maintain in a rearward inclination status at an R angle. The drawer 40 is mounted on top of the top wall 28 of the second rail 14 with the protrusion 34 holding against the bottom of the drawer 40. The drawer 40 has an engaging hole 44 for the engaging member 36 to insert therein. The height D2 of the protrusion 34 is substantially equal to the height difference D1, which is adapted to compensate the angle of inclination of the drawer 40 in the cabinet 38. In other words, when the drawer 40 is mounted in the cabinet 38, the drawer slide 10 is in a rearward inclination status with respect to the cabinet 38 because of the arrangement of the first installation section 22 and the second installation section 24. Therefore, the drawer panel 42 is in an inclined status with respect to the cabinet 38. The protrusion 34 protruding from the top wall 28 of the second rail 14 is used to hold against the bottom of the drawer 40 so as to compensate the angle of inclination of the drawer panel 42 with respect to the cabinet 38 for maintaining the drawer panel 42 of the drawer 40 in a level status with respect to the cabinet 38. This will prevent the drawer 40 from sliding out of the cabinet 38, providing a steady extension or retraction.

Figure 4:
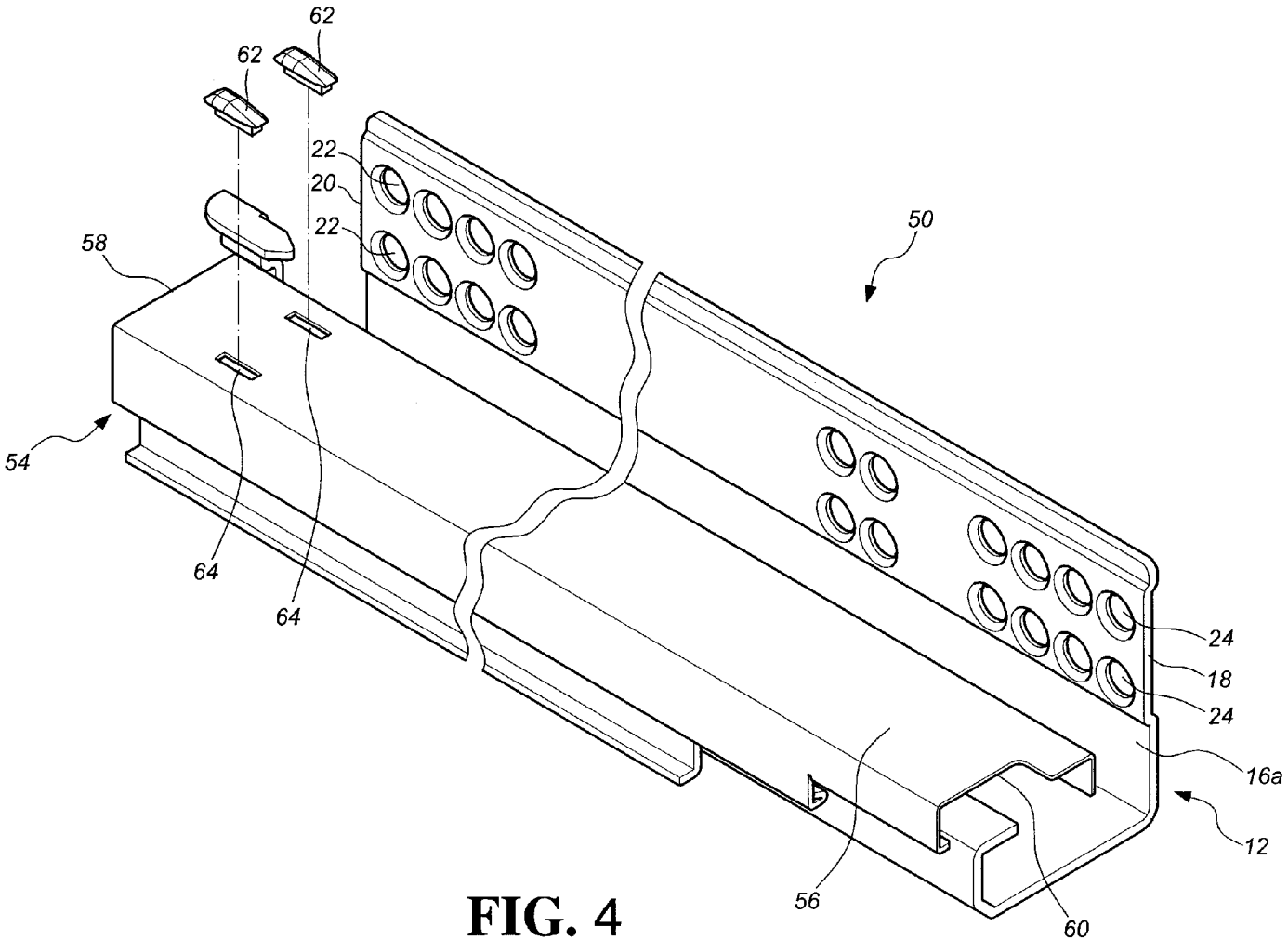
FIG. 4 is a perspective view of an undermount drawer slide according to a second embodiment of the present invention.

FIG. 4 is a perspective view of a drawer slide 50 according to a second preferred embodiment of the present invention, which is substantially similar to the first preferred embodiment. The drawer slide 50 includes a first rail 12 and a second rail 54. The arrangement of the first rail 12 in the second embodiment is identical to that of the first embodiment. The second rail 54 includes a top wall 56 which has a first end 58 and a second end 60 opposite to the first end 58, and at least one fitting member 62 is mounted on the top wall 56 between the first end 58 and the second end 60. Preferably, the fitting member 62 is disposed near the first end 58 of the top wall 56, and the height of the fitting member 62 measured from the top wall 56 is substantially equal to the height difference D1 of the first rail 12. In this embodiment, the top wall 56 is formed with at least one installation hole 64 for the fitting member 62 to be secured thereat.

Figure 5:
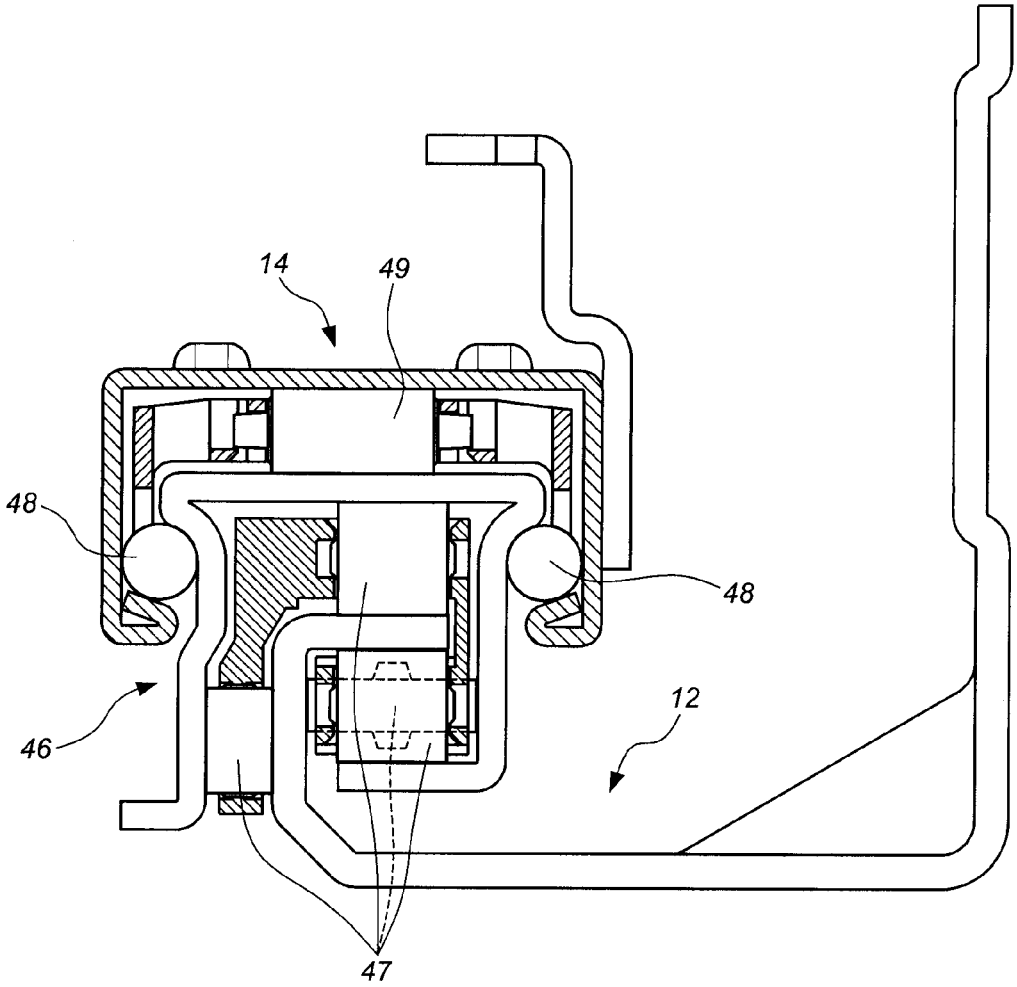
FIG. 5 is a cross-sectional view of the present invention further comprising a third rail.

Referring to FIG. 5, the first embodiment of the present invention further comprises a third rail 46 slidably mounted between the first rail 12 and the second rail 14, at least one first auxiliary sliding member 47, such as a roller, which is located between the first rail 12 and the third rail 46, at least one second auxiliary sliding member 48, such as a ball, and at least one third auxiliary sliding member 49, such as a roller, which are located between the second rail 14 and the third rail 46. With the first auxiliary sliding member 47, the second auxiliary sliding member 48, and the third auxiliary sliding member 49, the third rail 46 is able to support the second rail 14 to slide with respect to the first rail 12 for a further extension. Likewise, the third rail 46 can be mounted between the first rail 12 and the second rail 54 of the second embodiment.

While we have shown and described the embodiment in accordance with the present invention, it should be clear to those skilled in the art that further embodiments may be made without departing from the scope of the present invention.

What is claimed is:

1. An undermount drawer slide, comprising:

a singular first rail including a vertical first wall, a first installation section and a second installation section offset each from the other disposed on the first wall adjacent respective opposing ends thereof, the first installation section having a first vertical distance measured from the center of the first installation section to a reference level on the first wall, the second installation section having a second vertical distance measured from the center of the second installation section to the reference level, the first vertical distance being different from the second vertical distance to form a height difference, D1, configured to provide a front to back downward inclination of the drawer slide when mounted to a fixed structure, and a second rail slidable linearly with respect to the singular first rail, the second rail including a top wall having a first end and a second end opposite to the first end, a protrusion disposed proximate the installation section having the greater vertical distance from the center of the installation section to the reference level on the first wall, the protrusion is disposed adjacent the first end of the top wall of the second rail, the protrusion having a height, D2, measured from the top wall which is formed substantially equal to the height difference, D1, between the first installation section and the second installation section to incline a drawer mounted on the top wall of the second rail in a direction opposite to the downward inclination of the drawer slide and thereby compensate for inclination of the drawer slide.

2. An undermount drawer slide as claimed in claim 1, wherein the first installation section is formed by a plurality of mounting holes and the second installation section is formed by a plurality of mounting holes, the plurality of mounting holes of the first installation section having corresponding first centerlines offset from second centerlines of the plurality of mounting holes of the second installation section by an amount equal to the height difference between the first installation section and the second installation section.

3. An undermount drawer slide as claimed in claim 2, wherein the first wall further includes a third installation section disposed between the first installation section and the second installation section, the third installation section is a plurality of mounting holes corresponding in position to the mounting holes of the first installation section and the second installation section.

4. An undermount drawer slide as claimed in claim 1, further comprising a third rail disposed between the singular first rail and the second rail in a slidable manner.

5. An undermount drawer slide as claimed in claim 1, further comprising an engaging member fixed to the second rail and adjacent to the protrusion.

* * * * *